US009711305B2

(12) United States Patent
Dodomeki et al.

(10) Patent No.: US 9,711,305 B2
(45) Date of Patent: Jul. 18, 2017

(54) MULTIDIRECTIONAL SWITCH DEVICE

(71) Applicant: KABUSHIKI KAISHA TOKAI RIKA DENKI SEISAKUSHO, Aichi (JP)

(72) Inventors: Kazuo Dodomeki, Aichi (JP); Tatsuya Futamura, Aichi (JP); Hisaya Tsujimoto, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 0 days.

(21) Appl. No.: 15/163,685

(22) Filed: May 25, 2016

(65) Prior Publication Data

US 2016/0358730 A1 Dec. 8, 2016

(30) Foreign Application Priority Data

Jun. 3, 2015 (JP) ..... 2015-113194

(51) Int. Cl.
*H01H 25/04* (2006.01)
*H01H 9/18* (2006.01)

(52) U.S. Cl.
CPC ..... *H01H 25/041* (2013.01); *H01H 9/182* (2013.01); *H01H 2025/043* (2013.01); *H01H 2025/048* (2013.01); *H01H 2219/062* (2013.01)

(58) Field of Classification Search
CPC ..... H01H 25/041; H01H 9/182; H01H 2025/043; H01H 2025/048; H01H 2219/062

(Continued)

(56) References Cited

U.S. PATENT DOCUMENTS 5,689,095 A * 11/1997 Kawase ..... H01H 25/008 200/5 R
8,530,767 B2 * 9/2013 Kuroda ..... H01H 23/168 200/17 R (Continued)

FOREIGN PATENT DOCUMENTS

EP 1339080 A1 8/2003
EP 2093785 A1 8/2009

(Continued)

OTHER PUBLICATIONS

Japanese Office Action dated Nov. 22, 2016 issued in Japanese Patent Application No. 2015-113194.

(Continued)

*Primary Examiner* — Edwin A. Leon

(57) ABSTRACT

A multidirectional switch device includes an assembled structure of a plurality of members, which include a user-operable button, and a holder that supports the assembled structure. The multidirectional switch device also includes a set of axial recesses and a set of axial projections that define a pivot axis about which the button pivots relative to the holder. The pivot axis is arranged to allow the holder to cooperate with the assembled structure for operation of the button in multiple directions. The holder includes one of the set of axial recesses and the set of axial projections. One of the members of the assembled structure other than the button includes the other one of the set of axial recesses and the set of axial projections.

10 Claims, 3 Drawing Sheets

(58) Field of Classification Search
USPC ..... 200/6 R, 5 A, 6 A, 5 R, 570, 5 E, 418, 200/17 R, 310–314, 517
See application file for complete search history.

(56) References Cited

U.S. PATENT DOCUMENTS

| | | | |
|---|---|---|---|
| 2003/0155225 | A1 | 8/2003 | Kondo et al. |
| 2005/0139458 | A1 | 6/2005 | Komatsu |
| 2009/0038929 | A1 | 2/2009 | Terao |

FOREIGN PATENT DOCUMENTS

| | | | |
|---|---|---|---|
| JP | 08-45393 | A | 2/1996 |
| JP | 2003-16875 | A | 1/2003 |
| JP | 2003-242863 | A | 8/2003 |
| JP | 2008-112737 | A | 5/2008 |
| JP | 2009-64773 | A | 3/2009 |
| WO | 2013/168721 | A1 | 11/2013 |

OTHER PUBLICATIONS

Extended European Search Report dated Sep. 28, 2016 issued in the European Patent Application No. 16171009.0.

* cited by examiner

MULTIDIRECTIONAL SWITCH DEVICE

CROSS-REFERENCE TO RELATED APPLICATIONS

This application is based upon and claims the benefit of priority from prior Japanese Patent Application No. 2015-113194, filed on Jun. 3, 2015, the entire contents of which are incorporated herein by reference.

FIELD

This disclosure relates to a multidirectional switch device including a button that is operable in multiple directions.

BACKGROUND

Japanese Laid-Open Patent Publication No. 2008-112737 describes a multidirectional switch device including a button that is operable in four directions.

FIG. 5 illustrates the structure of a conventional multidirectional switch device 51. The switch device 51 includes a button 52 and a holder 53 that supports the button 52 to be operable in multiple directions. The button 52 includes axial holes 54. The holder 53 includes axial projections 55, which are fitted into the axial holes 54. The axial holes 54 and the axial projections 55 define a pivot axis. The button 52 is supported by the holder 53 and pivotal about the pivot axis. The switch device 51 further includes a board 56 that has fixed contacts (not illustrated), a rubber component 57 that has movable contacts (not illustrated) opposed to the fixed contacts, and pushers 58 that push the rubber component 57 when the button 52 is operated. The switch device 51 includes a body 59 that supports the holder 53 together with the board 56, the rubber component 57, and the pushers 58. When the button 52 is operated, each pusher 58 pushes a portion of the rubber component 57. One of the movable contacts of the rubber component 57 is shifted from an initial position to contact one of the fixed contacts of the board 56. This activates the switch device 51 and executes control corresponding to the operated position of the button 52, for example, control of a vehicle accessory (in one example, music selection of audio device).

In the multidirectional switch device 51 including the button 52 that is operable in four directions, the button 52 includes an operation surface provided with four operation positions located at ninety-degree intervals, and four pushers 58 (two of which are illustrated in FIG. 5) are arranged in correspondence with the four operation positions. The pivot axis, which is defined by the axial holes 54 and the axial projections 55 as described above, allows for operations of the button 52 in four directions.

As illustrated in FIG. 6, the button 52 may be formed using a mold. In this case, to allow the mold to slide, the axial holes 54 need to be located below a lower end of an overhang portion of the button 52. Therefore, the structure for sliding the mold imposes limitations on the position where the axial holes 54 are formed. It is thus difficult to reduce the thickness of the button 52 and, ultimately, the thickness of the multidirectional switch device 51.

SUMMARY

One aspect of a multidirectional switch device includes an assembled structure of a plurality of members, the plurality of members including a button that is operable by a user. The multidirectional switch device also includes a holder that supports the assembled structure. The multidirectional switch device further includes a set of axial recesses and a set of axial projections that define a pivot axis about which the button pivots relative to the holder. The pivot axis is arranged to allow the holder to cooperate with the assembled structure for operation of the button in multiple directions. The holder includes one of the set of axial recesses and the set of axial projections. One of the members of the assembled structure other than the button includes the other one of the set of axial recesses and the set of axial projections.

Other aspects and advantages of the embodiments will become apparent from the following description, taken in conjunction with the accompanying drawings, illustrating by way of example the principles of the invention.

It is to be understood that both the foregoing general description and the following detailed description are exemplary and explanatory and are not restrictive of the invention, as claimed.

BRIEF DESCRIPTION OF THE DRAWINGS

The embodiments, together with objects and advantages thereof, may best be understood by reference to the following description of the presently preferred embodiments together with the accompanying drawings in which.

DESCRIPTION OF THE EMBODIMENTS

One embodiment of a multidirectional switch device 1 will now be described.

Figure 1:
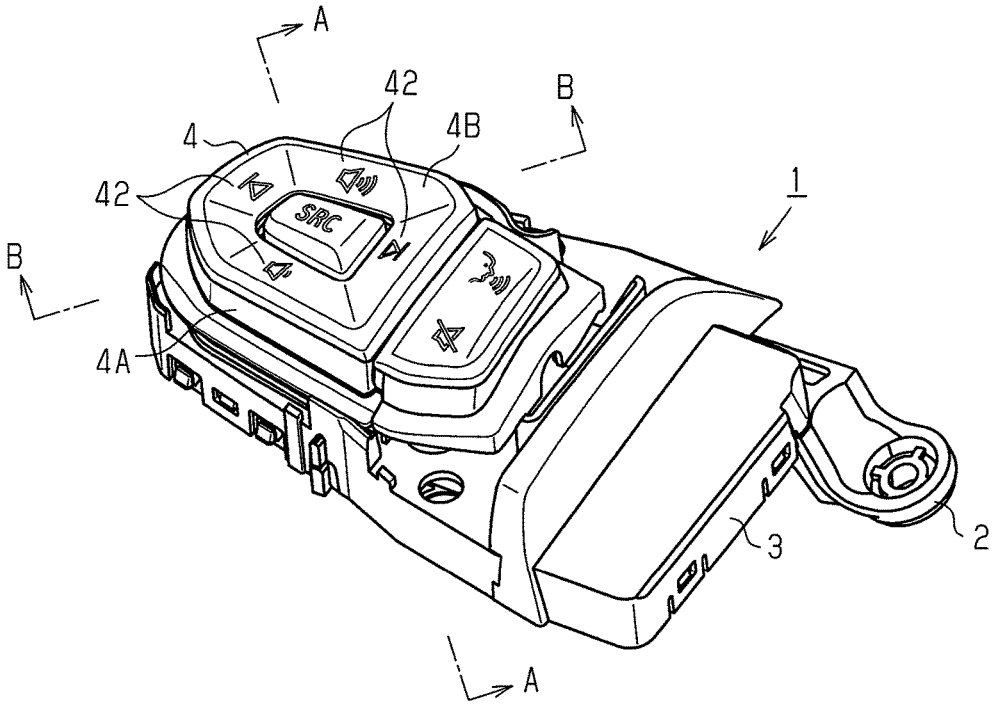
FIG. 1 is a perspective view of a multidirectional switch device.

As illustrated in FIG. 1, the multidirectional switch device 1 is, for example, a steering switch located at a position that allows the driver to easily operate, for example, an audio device, which is a vehicle accessory when selecting music or adjusting the volume.

The multidirectional switch device 1 includes a cover 2 and a body 3. The cover 2 is fixed near the steering wheel to the vehicle and coupled to the body 3. The cover 2 covers a switching function component such as a switching board that is supported by the body 3.

In the present example, the multidirectional switch device 1 includes buttons (operation members) that operate the switching function component. One of the buttons functions as a four-direction operation button 4 (hereafter, simply referred to as the button 4). The button 4 includes an operation surface defining an ornamental surface. A tetragonal hole extends through a central portion of the operation surface. The operation surface has the form of a tetragonal frame. The operation surface includes four operation portions arranged at ninety-degree intervals. In the present example, the operation surface, in the clockwise direction, includes an operation portion for increasing the volume at the twelve o'clock position, an operation portion for selecting music in the forward direction at the three o'clock position, an operation portion for decreasing the volume at the six o'clock position, and an operation portion for selecting music in the reverse direction at the nine o'clock position.

Figure 2:
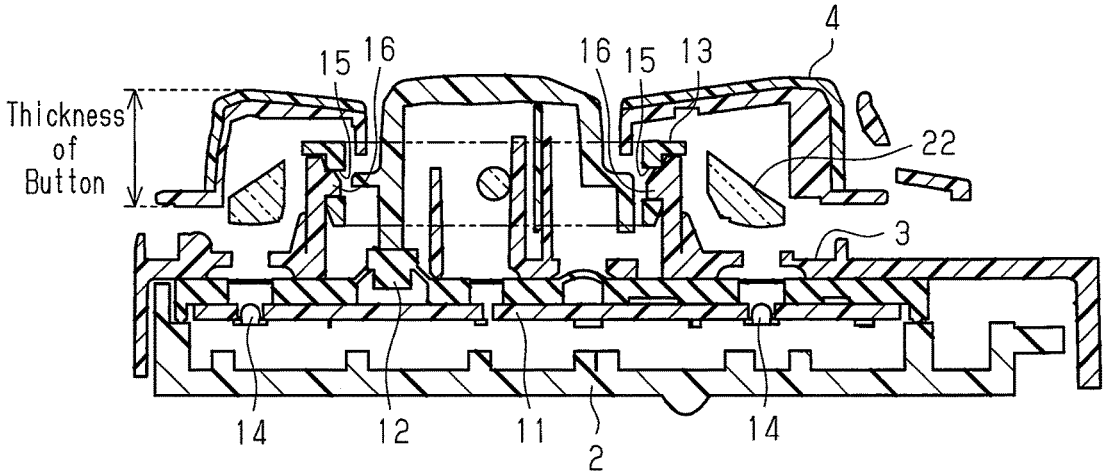
FIG. 2 is a cross-sectional view taken along line A-A in FIG. 1.

The button 4 includes a button body 4A and an ornamental cover 4B that covers the button body 4A. The button body 4A includes four windows 41 (refer to FIG. 4) located at positions corresponding to the four operation portions. The ornamental cover 4B includes four symbols 42 located immediately above the four windows 41. Each symbol 42 is one example of an ornamental portion. As illustrated in FIG. 2, the multidirectional switch device 1 includes light emitting diodes (LEDs) 14, which function as light sources. Light from the LEDs 14 is transmitted through the windows 41 and illuminates the symbols 42. This realizes a nighttime illumination function.

Although not described in detail, as illustrated in FIG. 1, another button is arranged to fill the central tetragonal hole of the button 4. A further button is arranged at the right side of the button 4. That is, the three buttons including the button 4 are arranged together on the multidirectional switch device 1.

As illustrated in FIG. 2, a board 11, a rubber component 12, and a holder 13 are supported by and fixed to the body 3, which serves as a support base. The board 11 includes fixed contacts (not illustrated), and the rubber component 12 includes movable contacts (not illustrated) opposed to the fixed contacts. Components, such as the LEDs 14 and chip resistors, are mounted on the board 11. The holder 13 supports an assembled structure of a plurality of members including the button 4 and cooperates with the assembled structure to allow for operations of the button 4 in multiple directions (four directions in the present embodiment). In the present example, the members of the assembled structure include the button 4 and a light guide 22 that surrounds the holder 13. The light guide 22 is located at a rear side of the symbols 42 of the button 4 and coupled to the button 4.

The holder 13 is substantially tetragonal. The holder 13 includes circular engagement holes 15 (engagement recesses). The engagement holes 15 are opposed to each other along one of two intersecting diagonal lines in a plan view. The body 3 includes rod-shaped engagement projections 16 located at positions corresponding to the engagement holes 15. When the set of the engagement projections 16 is engaged with the set of the engagement holes 15, the holder 13 is supported by and fixed to the body 3. Portions that fix the holder 13 to the body 3, that is, the set of the engagement holes 15 and the set of the engagement projections 16 are located within the thickness of the button 4. The thickness of the button 4 corresponds to the distance from the operation surface of the button 4 to the lower end of an overhang portion of the button 4. Thus, the set of the engagement holes 15 and the set of the engagement projections 16 are located above the lower end of the overhang portion of the button 4.

Figure 3:
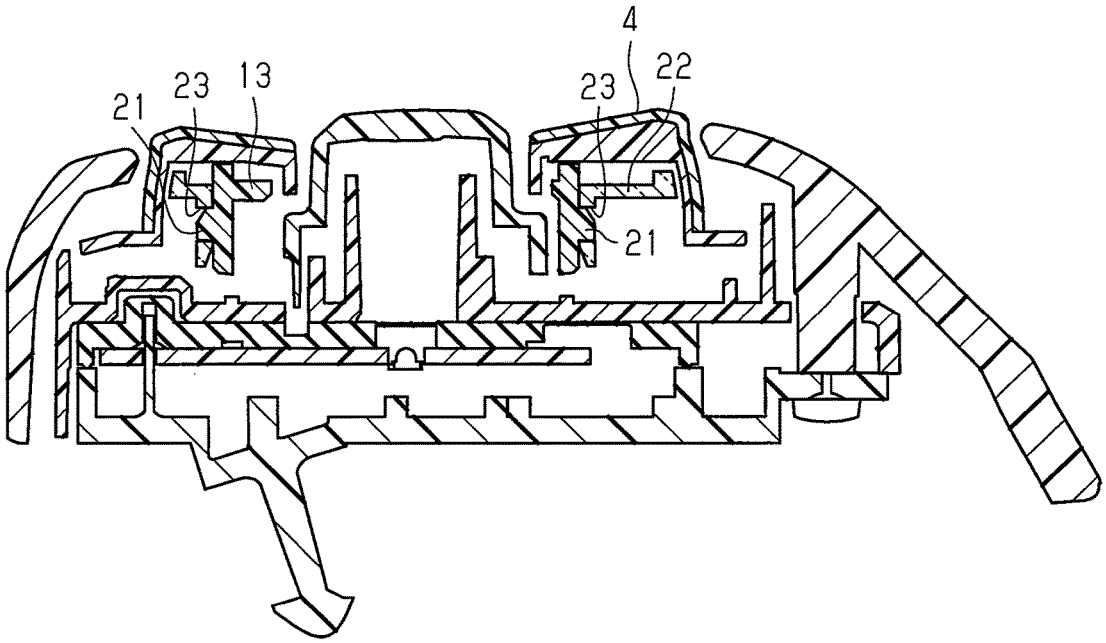
FIG. 3 is a cross-sectional view taken along line B-B in FIG. 1.

As illustrated in FIG. 3, the holder 13 further includes rod-shaped axial projections 21 opposed to each other along the other one of the two diagonal lines. The light guide 22, which surrounds the holder 13, includes circular axial holes 23 (axial recesses) located at positions corresponding to the axial projections 21. The axial projections 21 are fitted into the axial holes 23 to support the light guide 22 with the holder 13. In the present example, as described above, the light guide 22 and the button 4 form the assembled structure. One of the members of the assembled structure other than the button 4 (light guide 22 in the present example) is pivotally supported by the holder 13 to allow the button 4 to be operated in four directions. In this manner, in the present example, the set of the axial projections 21 and the set of the axial holes 23 define a pivot axis about which the button 4 pivots relative to the holder 13, and the pivot axis is arranged to allow the holder 13 to cooperate with the assembled structure for operation of the button 4 in four directions. In this structure, the holder 13 includes one of the set of the axial projections 21 and the set of the axial holes 23 (in the present example, axial projections 21), and the light guide 22 includes the other one of the set of the axial projections 21 and the set of the axial holes 23 (in the present example, axial holes 23). The pivot axis (axial projections 21 and axial holes 23) is located within the thickness of the button 4. That is, the set of the axial projections 21 and the set of the axial holes 23 are located above the lower end of the overhang portion of the button 4 (refer to FIG. 2).

Figure 4:
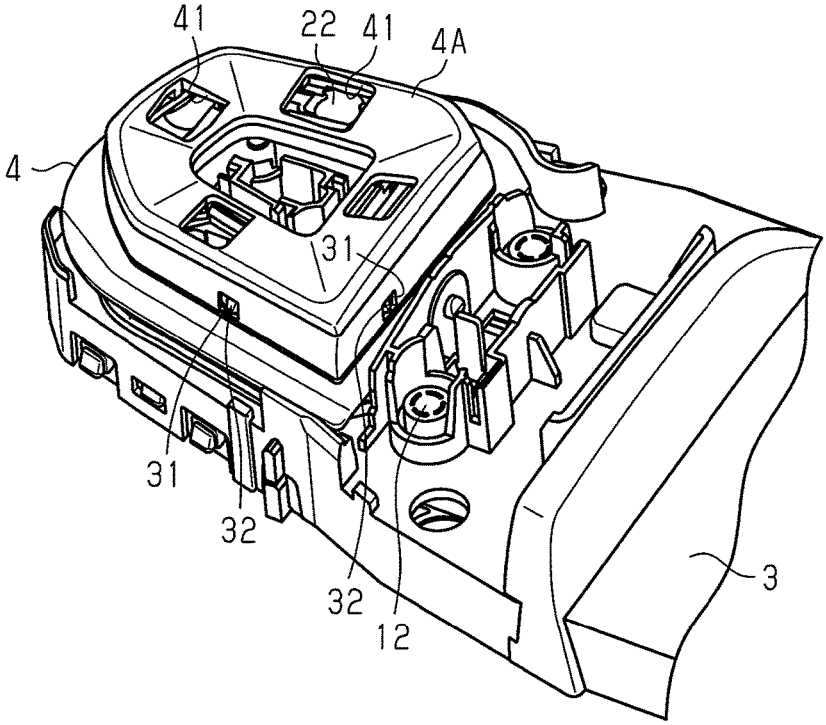
FIG. 4 is a perspective view illustrating a four-direction operation button coupled to a light guide with hooks inserted into engagement holes.
Figure 5:
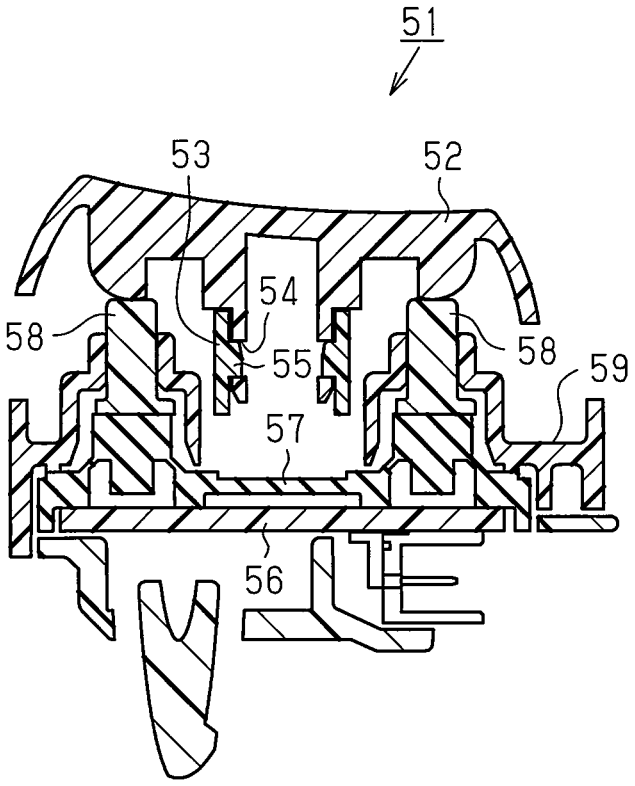
Fig.5 (Related Art)
FIG. 5 is a cross-sectional view illustrating a multidirectional switch device in a related art.
Figure 6:
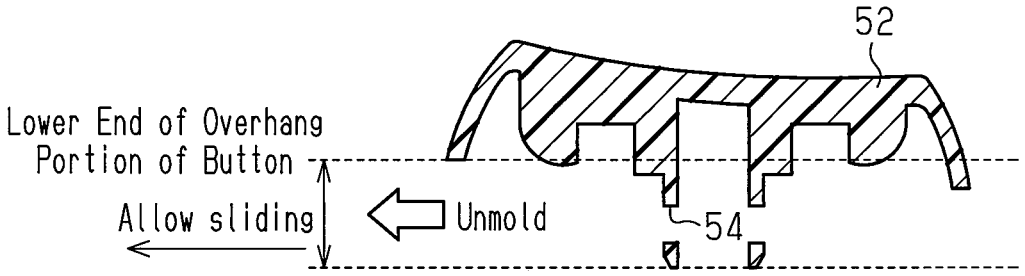
Fig.6 (Related Art)
FIG. 6 is a cross-sectional view illustrating the limitations on the structure for sliding a mold.

As illustrated in FIG. 4, three tetragonal engagement slots 31 (only two illustrated in FIG. 4) extend through side walls of the button 4 (button body 4A) in the assembled structure. When viewing the side walls of the button 4 from the outer side, each engagement slot 31 is entirely visible in the thickness-wise direction of the button 4. The light guide 22, which is a coupling subject of the button 4, includes rod-shaped hooks 32 located at positions corresponding to the engagement slots 31. The hooks 32 are fitted into the engagement slots 31 to couple the button 4 to the light guide 22. Thus, the assembled structure is formed by integrating the button 4 and the light guide 22. Portions that fix the light guide 22 to the button 4 are located within the thickness of the button 4. That is, the hooks 32 and the engagement slots 31 are located above the lower end of the overhang portion of the button 4 (refer to FIG. 2).

The operation of the multidirectional switch device 1 will now be described.

Referring to FIG. 4, when molding the four-direction operation button 4 (button body 4A), the engagement slots 31 may be formed by sliding a mold toward an outer side of the button 4. When the side walls of the button 4 are viewed from an outer side, the engagement slots 31 are entirely visible in the thickness-wise direction of the button 4. Thus, the button 4 does not include portions that interfere with the sliding of the molds at the outer side of the engagement slots 31. This avoids increases in the thickness of the button 4 that would result from the positions where the engagement slots 31 are located. That is, the structure for sliding the mold does not impose limitations on the thickness of the button 4.

In the process for assembling the multidirectional switch device 1, the holder 13 is coupled to the body 3, and the light guide 22 is coupled to the holder 13. Subsequently, the button 4, which is molded in the above manner, is coupled to the light guide 22. The holder 13 is coupled to one side of the body 3. The board 11 and the rubber component 12 are coupled to the other side of the body 3. When coupled to the body 3, the cover 2 covers the board 11 and the like.

After the multidirectional switch device 1 is assembled, the multidirectional switch device 1 is coupled to a vehicle by the cover 2. When one of the four operation portions of the button 4 is operated, the corresponding portion of the light guide 22, which is supported by the holder 13, pushes a portion of the rubber component 12. This moves one of the movable contacts of the rubber component 12 from the initial position to where the movable contact comes into contact with one of the fixed contacts of the board 11 and activates the switch device 1. For example, when the operation portion of the button 4 corresponding to the three o'clock position is operated, the switch device 1 instructs an audio device (not illustrated) to select music in the forward direction. In the present example, the light guide 22, to which the button 4 is coupled, is located between the button 4 and the rubber component 12 to function as a pusher that pushes the rubber component 12 toward the board 11 and brings one of the movable contacts into contact with one of the fixed contacts when the button 4 is operated.

When the headlights are turned on, for example, during the nighttime, the LEDs 14 are also activated. The light from the LEDs 14 is guided to the ornamental surface (ornamental cover 4B) of the four-direction operation button 4 through the light guide 22. This illuminates the symbols 42 of the ornamental cover 4B.

The present embodiment has the advantages described below.

(1) The light guide 22, which is separate from the four-direction operation button 4, includes the pivot axis (axial holes 23 of pivot axis, in the present example). Thus, the thickness of the button 4 (button body 4A), which is formed by a mold, is not limited by the sliding structure of the mold. In other words, the pivot axis (axial projections 21 and axial holes 23) is set within the thickness of the button 4. This reduces the thickness of the button 4 and, ultimately, the thickness of the multidirectional switch device 1.

(2) When a mold is used to form the engagement slots 31 in the button 4 (button body 4A), the mold is allowed to slide toward an outer side of the button 4. When the hooks 32 are fitted into the engagement slots 31, the button 4 is coupled to the light guide 22. Thus, the portions that fix the light guide 22 to the button 4, that is, the hooks 32 and the engagement slots 31, are located within the thickness of the button 4. This reduces the thickness of the button 4.

(3) The component to which the button 4 is coupled is the light guide 22, which is located at the rear side of the symbols 42 of the button 4. This structure realizes the nighttime illumination function that illuminates the symbols 42 of the button 4 through the light guide 22.

(4) The portions that fix the holder 13 to the body 3, that is, the engagement holes 15 and the engagement projections 16, are located within the thickness of the button 4. This reduces the thickness of the button 4.

(5) The light guide 22 includes the pivot axis (axial holes 23). This reduces the thickness of the button 4 having the nighttime illumination function.

It should be apparent to those skilled in the art that the foregoing embodiments may be employed in many other specific forms without departing from the scope of this disclosure. Particularly, it should be understood that the foregoing embodiments may be employed in the following forms.

In the embodiment, referring to FIG. 3, the holder 13 includes the axial projections 21, and the light guide 22 includes the axial holes 23 (axial recesses). Instead, the holder 13 may include axial recesses, and the light guide 22 may include axial projections. Additionally, the axial recess is not limited to an axial hole that extends through a wall and may be an axial groove that does not extend through the wall. The axial recess (axial projection) is not limited to the circular shape and may have any shape. Also, the axial recess (axial projection) may have any size (diameter, depth).

In the above embodiment, referring to FIG. 2, the body 3 includes the engagement projections 16, and the holder 13 includes the engagement holes 15 (engagement recesses). Instead, when the body 3 includes engagement recesses, the holder 13 may include engagement projections. Additionally, an engagement recess is not limited to an engagement hole that extends through a wall and may be an engagement groove that does not extend through the wall. The engagement recess (engagement projection) may have any shape and any size.

Referring to FIG. 4, the engagement slots 31 may have any shape and any size that is in conformance with the hooks 32. When the button 4 does not include portions that interfere with the sliding of a mold at an inner side of the engagement slots 31, the mold may slide toward the inner side of the engagement slots 31. In this case, engagement grooves that do not extend through the wall may be used instead of the engagement slots 31.

The assembled structure of the members including the button 4 may include a further member instead of or in addition to the light guide 22. In this case, the further member may define the pivot axis. For example, when the assembled structure includes only the button 4 and the further member but does not include the light guide 22, the further member may include the axial holes 23 defining the pivot axis in lieu of the light guide 22. Thus, the component to which the button 4 is coupled is not limited to the light guide 22.

In the above embodiment, the button 4 includes the button body 4A and the ornamental cover 4B. The button body 4A including the windows 41 is located at the rear side of the ornamental cover 4B including the symbols 42. The light guide 22 is located at the rear side of the button body 4A. However, the button 4 is not limited to the structure including the button body 4A and the ornamental cover 4B. For example, the button 4 may have a single-body structure that includes the symbols 42. In this case, the light guide 22 may be located at the rear side of the symbols 42 of the button having the single-body structure. Additionally, the button having the single-body structure may include the engagement slots 31. When the symbols 42 are illuminated by the light guide 22, the button 4 may be divided into three or more components.

As long as there is at least one multidirectional operation button (in one example, four-direction operation button 4), the multidirectional switch device 1 may include a further button.

The light guide 22 may be a two-color molded component formed by a light transmitting portion and a non-transmitting portion. In this structure, the non-transmitting portion limits unnecessary reflection and leakage of light.

The light source is not limited to the LEDs 14. Further, there may be any number of light sources.

The structure of the above multidirectional switch device 1 is applicable to any switch device other than a steering switch. The installation of the multidirectional switch device 1 is not limited to a vehicle. The multidirectional operation button is not limited to the four-direction operation button 4.

The present examples and embodiments are to be considered as illustrative and not restrictive, and the invention is not to be limited to the details given herein, but may be modified within the scope and equivalence of the appended claims.

The invention claimed is:

1. A multidirectional switch device comprising:

an assembled structure of a plurality of members, the plurality of members including a button that is operable by a user and a component to which the button is coupled;

a holder that supports the assembled structure; and a set of axial recesses and a set of axial projections that define a pivot axis about which the button pivots relative to the holder, wherein the pivot axis is arranged to allow the holder to cooperate with the assembled structure for operation of the button in multiple directions, wherein the holder includes one of the set of axial recesses and the set of axial projections, and the component of the members of the assembled structure includes the other one of the set of axial recesses and the set of axial projections.

2. The multidirectional switch device according to claim 1, wherein the button includes a side wall including an engagement slot, the component includes a hook that is fitted into the engagement slot of the button, and when the side wall of the button is viewed from an outer side, the engagement slot is entirely visible in a thickness-wise direction of the button.

3. The multidirectional switch device according to claim 1, wherein the members of the assembled structure include a light guide to which the button is coupled, the button includes a symbol that functions as an ornamental portion, and the light guide is located at a rear side of the symbol of the button to illuminate the symbol.

4. The multidirectional switch device according to claim 1, further comprising:

a body that supports and fixes the holder; and a set of engagement recesses and a set of engagement projections that are engaged with each other to fix the holder to the body, wherein the body includes one of the set of engagement recesses and the set of engagement projections, the holder includes the other one of the set of engagement recesses and the set of engagement projections, and the set of engagement recesses and the set of engagement projections are located within a thickness of the button.

5. The multidirectional switch device according to claim 1, wherein the button includes an ornamental portion, the members of the assembled structure include a light guide that guides light from a light source to the ornamental portion of the button, and the light guide includes the other one of the set of axial recesses and the set of axial projections.

6. The multidirectional switch device according to claim 3, wherein the light guide includes a two-color molded component formed by a light transmitting portion and a non-transmitting portion.

7. The multidirectional switch device according to claim 3, further comprising:

a board that includes fixed contacts; and a rubber component that includes movable contacts and is located on the board, wherein the light guide is located between the button and the rubber component to function as a pusher that pushes the rubber component toward the board and brings one of the movable contacts into contact with one of the fixed contacts when the button is operated.

8. The multidirectional switch device according to claim 1, wherein the component is fixed to the button so that the button and the component are integrally pivoted about the pivot axis.

9. The multidirectional switch device according to claim 8, wherein a position Where the component is fixed to the button is set within a thickness of the button above a lower end of an overhang portion of the button.

10. The multidirectional switch device according to claim 1, wherein the set of axial recesses and the set of axial projections are located within a thickness of the button above a lower end of an overhang portion of the button.

* * * * *